US005125481A

United States Patent [19]

Shibata

[11] Patent Number: 5,125,481

[45] Date of Patent: Jun. 30, 1992

[54] DIAGONAL ELEVATION APPARATUS

[76] Inventor: Hideaki Shibata, 16-5, Wagogaoka 2 Chome, Togo-Cho, Aichi-Gun, Aichi-Ken, Japan

[21] Appl. No.: 588,243

[22] Filed: Sep. 26, 1990

[51] Int. Cl.[5] ..... B66B 9/06

[52] U.S. Cl. ..... 187/12; 187/94; 187/95

[58] Field of Search ..... 187/12, 17, 94, 95

[56] References Cited

U.S. PATENT DOCUMENTS

| | | | |
|---|---|---|---|
| 2,707,530 | 5/1955 | Bromberg | 187/17 |
| 3,120,880 | 2/1964 | Jaseph | 187/17 |
| 3,968,861 | 7/1976 | Kernen | 187/17 |
| 4,457,402 | 7/1984 | Del Vecchio et al. | 187/12 |
| 4,716,989 | 1/1988 | Coleman et al. | 187/94 X |
| 4,979,593 | 12/1990 | Watanabe et al. | 187/12 |
| 5,005,672 | 4/1991 | Nakai et al. | 187/112 X |

FOREIGN PATENT DOCUMENTS

| | | |
|---|---|---|
| 3422374A1 | 12/1985 | Fed. Rep. of Germany . |
| 252889 | 2/1990 | Japan . |
| 1512779 | 6/1978 | United Kingdom . |

*Primary Examiner*—Robert P. Olszewski
*Assistant Examiner*—Dean A. Reichard
*Attorney, Agent, or Firm*—Lowe, Price, LeBlanc & Becker

[57] ABSTRACT

A diagonal elevation apparatus comprises a frame fitted to a sloped surface connecting the floor surface of a lower floor to the floor surface of an upper floor, a platform and a counterweight. The platform is disposed inside the frame and has first guide rollers guided by first guide rails, and a platform gate on a step surface. The counter-weight is equipped with second guide rollers and has second guide rails for the second guide rollers. The second guide rails are disposed inside the first guide rails. The platform and the counter-weight are connected to each other by divided plain belts through pulleys disposed at the upper and lower ends of the frame at the front and back of the platform and the counter-weight. The diagonal elevation apparatus further comprises means for moving the platform, comprising a linear motor fixed inside the frame and a brake device, or a variable speed motor equipped with a reduction gear.

15 Claims, 9 Drawing Sheets

Fig. 1
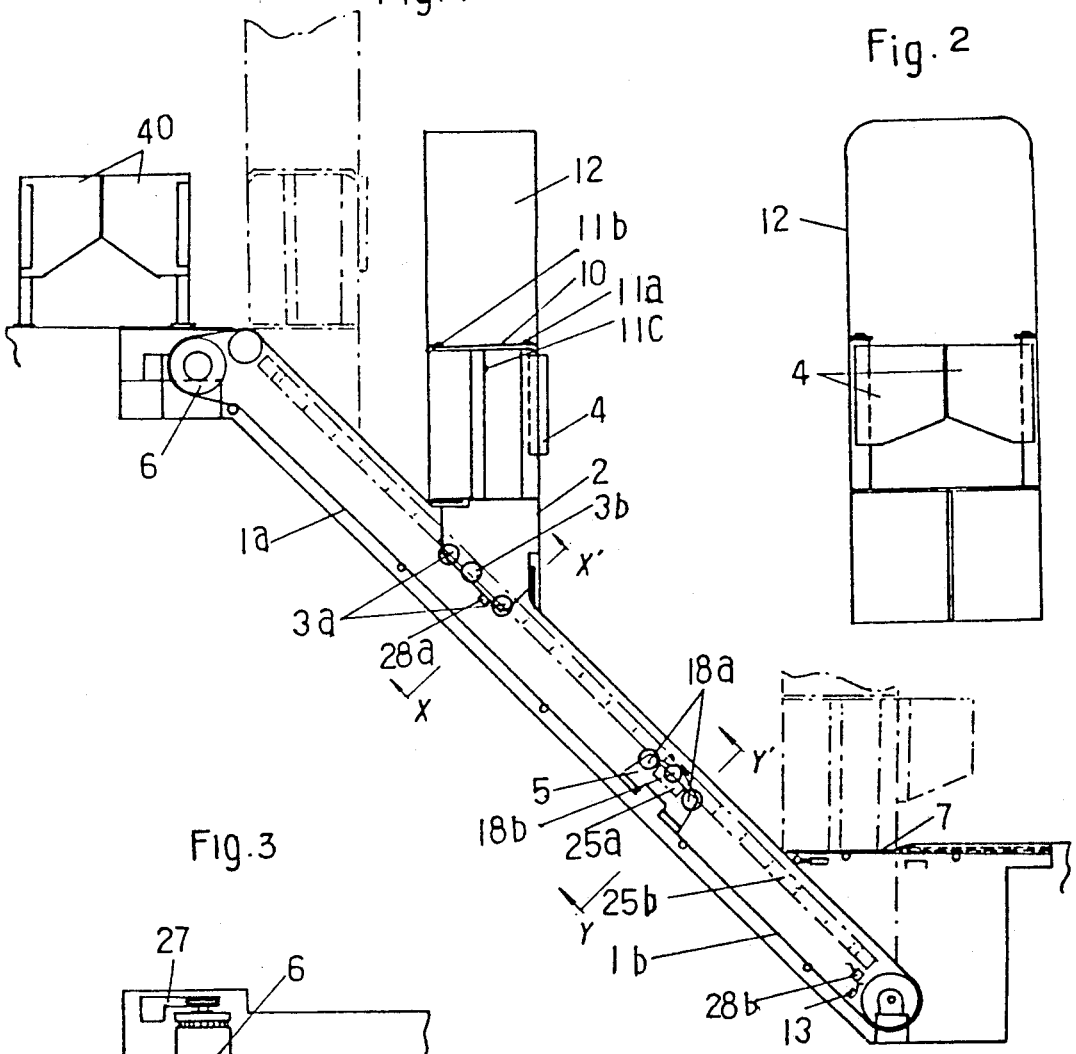
Fig. 2
Fig. 3
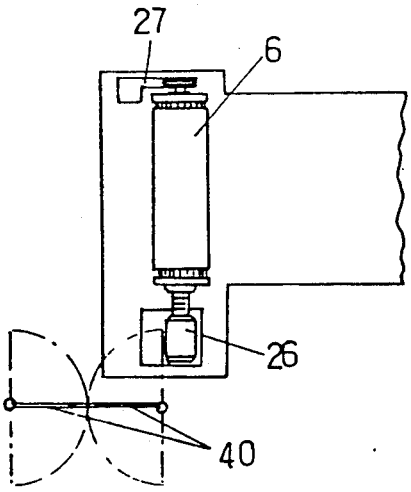

DIAGONAL ELEVATION APPARATUS

BACKGROUND OF THE INVENTION

1. Field of the Invention

This invention relates to a diagonal elevation apparatus for installation between upper and lower floors of a building, a man elevator installed integrally with a building, and a control system for the man elevator.

2. Description of the Prior Art

Conventionally, man elevation apparatuses to be installed integrally in a building have been elevators and escalators.

In the elevator, a cage is suspended by steel ropes and moved up and down intermittently by tension rollers. To provide friction with the roller surface, a counter-weight is suspended on the opposite side of the steel ropes. The cage moves up and down substantially vertically and is driven by electric power or the like to improve operation speed. In contrast, the escalator has a chain conveyor for man for continuous operation which is disposed between floor of a building with an inclination angle of approximately 25°. Step-like step plates are guided appropriately by use of two chains. It becomes step-like at the inclined portions and becomes a horizontal support surface at the floors of the upper and lower floors. Generally, it is driven by electric power and its speed is low.

However, when the elevator facility described above is installed inside a building, it has been necessary in the past for the building to have a specific structure, strength or space so as to satisfy the requirements for load resistance and elevation slope and this results in the drawbacks that the weight and power of the apparatus become great and noise occurs. In the escalator, the angle of inclination must be limited to a relatively low angle (approx. 25°) in order to prevent fall-off of passengers one upon another, particularly when a large number of passengers use the escalator. This means that a greater space is necessary. Since the step surface becomes a narrow step-like portion a the inclined portion of the escalator, the use of a wheelchair has been difficult. On the other had, the elevator has disadvantages in that the passengers are confined inside the cage at the time of accident or service failure and a refuge path is difficult to secure. Futhermore, these facilities must be provided with a safety device lest the platform for the passengers moves up and down accidentally due to cut-off of the driving belts.

However, no elevator facilities which solve the problems of the conventional escalators and elevators have yet been accomplished, and installation of even the conventional escalators and elevators has been extremely difficult, particularly in houses in general having a limited space.

SUMMARY OF THE INVENTION

It is therefore a primary object of the present invention to provide an elevation method and apparatus therefor which does not need specific structure, space and machine room in a building, can reduce necessary power and the occurrence of noise, can enlarge an inclination angle, makes it easy to use a wheelchair, can secure a refuge passage, does not causes accident fall and rise and in hence safe, and can be easily employed for houses.

To accomplish the objects described above, in the elevation method and apparatus of the present invention employ a platform 2 on which passengers are carried and which connects a lower floor and an upper floor. The platform 2 is a single member 1 and the platform 2 and a counter-weight 5 are connected by plain belts. A frame 29 is fitted to a slope surface connecting the lower floor and the upper floor; guide rails 30 for guide rollers of the platform are disposed inside the frame. The platform is provided with platform guide rollers 3*a*, 3*b* guided by the guide rail 30 and with a platform gate 4; and the counter-weight 5 has guide rails 31 for guide rollers disposed inside the guide rails 30 for guide rollers of the platform 2 and the guide rollers 18*a*, 18*b* guided by the guide rails 31. The platform 2 and the counter-weight 5 are connected to each other by the divided plain belts 1*a*, 1*b* through pullies 6 disposed at the upper and lower end portions of the frame 29 at the front and back of the platform 2 and the counter-weight upward and downward movement and stopping of the platform are secured by a primary side stator 25*b* of a linear motor 35 fixed inside the frame 29, a secondary side moving element 25*a* fixed to the counter-weight 5 and corresponding to the primary side stator 25 and brake devices fitted to pulley shafts, or the platform is moved up and down by driving a variable speed motor equipped with a reduced gear which is connected to the pulley shaft depending on the transportation load of the platform 2, the strength of the building, allowable electric power, allowable limit of noise, and so forth. This elevation apparatus is fixed along a slope surface between the upper and lower floors of a building. The guide rails 31 for guide rollers of the counter-weight 5 are disposed inside and on both sides of the frame 29 for guiding the platform 2 and the counter-weight 5, and the guide rails 30 for guide rollers of the platform 2 are disposed on the same plane as, and outside, the guide rails 31 of the counter-weight 5. The plain belts 1*a*, 1*b* have teeth 16 having such a shape as to mesh with teeth of the pullies 6 when the plain belts 1*a*, 1*b* are wound into the pullies 6, and include a buried wire rope 15 at the portions of the teeth 16 are at other portions as a buried core material, together with a cloth-like reinforcing material and a flexible decorative sheet which is extended on the surface opposite to the surface where the teeth 16 are disposed. These plain belts 1*a*, 1*b* are used as the connection members between the platform 2 and the counter-weight 5. Furthermore, the platform 2 has the platform gate 4 on the step surface and when the step surface of the platform 2 is on the floor surface of the lower floor and is stopped, this platform gate 4 is opened or closed by signals through push bottons 11*a*, 11*b*, 11*c* of the platform 2 or its current collector 44 as a power feed member 43 is the frame inside the pit and the current collector 44 communicate with each other and relay the power. Connection between the platform 2 and the plain belts 1*a*, 1*b* is made at the front and back in the travelling direction of the platform and in the horizontal direction parallel to the step surface of the platform on the side of the upper floor and in the vertical direction parallel to the vertical surface of the platform 2 on the side of the lower floor, by means of lashing metals 22 having a partially cylindrical section orthogonal to the travelling direction at the portions coming into contact with the upper surfaces of the plain belts 1*a*, 1*b* and by lashing metals 23 having a shape coming into close contact with the plain belts 1*a*, 1*b* at the portions coming into contact with the lower surfaces of the plain belts, respectively. Furthermore, the buried wire ropes 15 are exposed from the end portions of the plain belts 1*a*, 1*b*, respectively, and are fixed to the platform 2.

On the other hand, the counter-weight 5 has the guide rollers 18*a*, 18*b* for the counter-weight and incorporates therein tension devices for the plain belts 1*a*, 1*b*. Connection between the counter-weight 5 and the plain belts 1*a*, 1*b* is made by means of lashing metals 22 having a shape coming into close contact with the plain belts 1*a*, 1*b* on their upper surfaces and by means of flat sheet-like lashing metals 23 on their lower surfaces. Furthermore, the buried wire ropes 15 are exposed from the end portions of the plain belts 1*a*, 1*b* and are fixed to the counter-weight 5, respectively.

The platform 2 includes the platform guide rollers 3*a*, 3*b*, the platform gate 4, a cover 12, the handrails 10, an electromagnetic transmitter 28*a* for remote control which uses a battery as a power source and push bottons 11*a*, 11*b*, 11*c* for upward movement, downward movement and emergency stop for operation, respectively.

The elevation apparatus includes a control system for controlling the elevation speed and the safety speed and the operation of the slide plate 7 of the lower floor pit by reading optical symbols written in the travelling direction of the plain belts 1*a*, 1*b*. The elevation speed levels corresponding to a pre-set position of the platform 2 and the position of the platform 2 at the time of non-load are written continuously in symbols for the full length of the platform 2 from the floor of the lower floor to that of the upper floor into a flexible tape 14 capable of writing such symbols onto its surface disposed inside the plain belts 1*a*, 1*b*. The tape 14 is bonded along the line of a reader 13 of the elevation apparatus at the positions where the position of the reader 13 corresponds to that of the platform 2. Similarly, the respective tapes 14 are bonded to the the lines of the corresponding readers 13 for the ascension of the platform 2 at the time of means load, the descension of the platform 2 at the time of non-load and the descension of the platform 2 at the time of mean load. Furthermore, the tape 14 having symbols for speed detection that are disposed equidistantly and the tape 14 for controlling the advancing and retreating speeds of the slide plate 7 are bonded along the line of each reader 13. When the platform 2 moves up from the lower floor, the slide plate 7 advances and follows up the platform 2 in synchronism with the rise of the platform 2 without forming a gap between the rear vertical surface or the platform and the floor surface of the lower floor and when the lower end of the rear vertical surface of the platform 2 leaves the lower floor pit, the slide plate 7 covers the entire surface of the pit. When the lower end of the rear back surface of the platform 2 comes into contact with the slide plate 7 at the time of descension of the platform 2, the slide plate 7 moves back in synchronism with the descension of the platform 2. Furthermore, the elevation apparatus includes a safety device for preventing the accidental fall and rise of the platform 2 when the plain belts 1*a*, 1*b* are cut off or when their connection with the platform 2 or with the counter-weight 5 is released, by wires 59 buried in the plain belts 1*a*, 1*b* through thin pipes 55, pawls 56 fitted to the platform 2 and teeth 58 fitted to the frame of the elevation apparatus.

In the apparatus of the present invention, the platform which moves up and down along the slope surface connecting the lower floor and the upper floor and which carries passengers is a single member and is connected to the counter-weight by the plain belts. Accordingly, the apparatus of the invention can prevent the passengers from falling down one upon another, can provide a large angle of inclination and can enlarge the step surface of the platform.

Since the platform and the guide rails of the counter-weight are disposed on the same plane inside the frame extending along the slop surface of a building, the installation space can be reduced.

Connection between the platform and the counter-weight by the plain belts can accomplish harmony with the building and the reduction of noise.

Since the teeth are formed on the plain belts and the buried wire ropes are buried into them as the core material, they provide the effects of increasing the strength of the plain belts and the prevention of slip and rolling.

The platform gate, the handrails and the cover are disposed in the platform and they contribute to safety of the passengers.

Since the elevation speed control is made in accordance with the load and with the UP/DOWN operation, it contributes to the reduction of the waiting time and to the improvement of safety.

Driving by the linear motor exhibit the noise control operation.

When the plain belts connecting the platform and the counter-weight are cut off or their connecting portions fall off during use, the wires in the flexible thin pipe buried in the plain belts are cut and the pawls fitted to the platform are caused to mesh with the teeth on the frame by the spring connected to the lever, so that the platform stops on the frame and its accidental fall or rise can be prevented.

The above and other objects and novel features of the present invention will become more apparent from the following description when taken in conjunction with the accompanying drawings.

BRIEF DESCRIPTION OF THE DRAWINGS

The accompanying drawings illustrate an example of an elevation method of a man elevator to be installed in a building, its apparatus, a control system of the apparatus and an apparatus for the control system in accordance with the present invention, wherein:

FIG. 1 is a side view of the apparatus as a whole;

FIG. 2 is a front view of a platform;

FIG. 3 is a plan view of pullies, a variable speed motor equipped with a reduction gear and a brake device on an upper floor;

DESCRIPTION OF THE PREFERRED EMBODIMENTS

Figure 4:
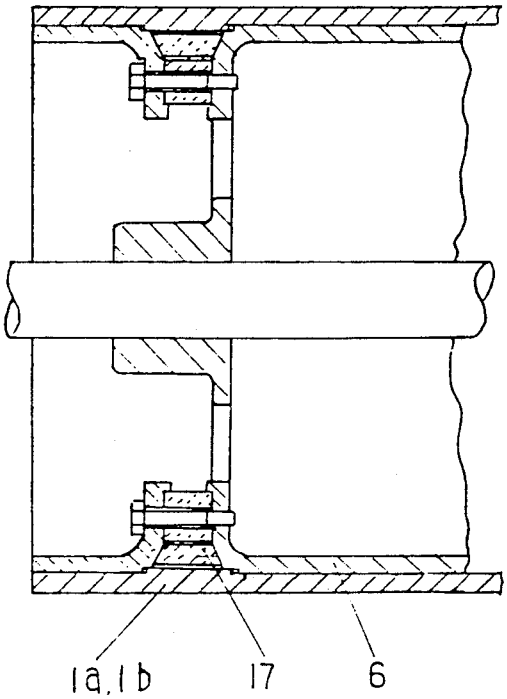
FIG. 4 is a partial sectional view of a pulley.
Figure 5:
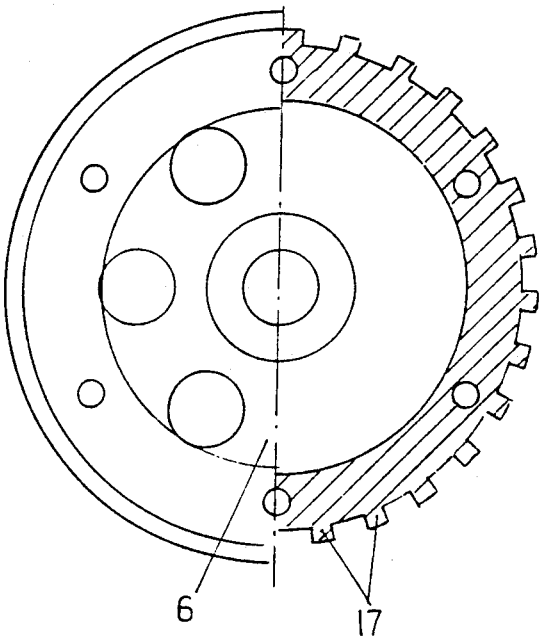
FIG. 5 is its side view.

Hereinafter, a preferred embodiment of the present invention will be described with reference to the accompanying drawings.

An elongated frame 29 is fitted along a slope surface which has a predetermined angle of inclination and connects pullies 6 disposed at an upper floor and a lower floor of a building, and guide rails 30 of a platform 2 for guide rollers are disposed inside the frame 29. The platform 2 has platform guiderollers 3*a*, 3*b* guided by the guide rails 30 and a platform gate 4 on a step surface, and a counter-weight 5 is disposed inside the guide rails 30 for the guide rollers of the platform 2. The counter-weight 5 is equipped with guide rollers 18*a*, 18*b* guided by guide rails 31 for the guide rollers. The platform 2 and the counter-weight 5 are connected to each other by divided plain belts 1*a*, 1*b* through the pullies 6, 6, disposed at the upper and lower end of the frame 29 at the front and back of the platform 2 and the counter weight 5. Ascension, descension and stop of the platform 2 are secured by a primary side stator 25*b* of a linear motor 35 fixed inside the frame 29, a secondary side moving element 25*a* fixed to the counter-weight 5 and corresponding to the stator 25*b* and a brake device 27 fitted to a pulley shaft.

In the drawings, reference numeral 61 represents a slide surface 16 at the tip surface of the plain belt 1*b* supported by the protuberances that are disposed on both side surfaces of the counter-weight 5 and reference numeral 60 represents a belt tension regulation spring of the plain belt 1*b* as a plain belt stretch device. The elevation speed of the platform 2 is regulated by operating a variable speed motor 26 equipped with a reduction gear which motor is interconnected to the pulley shaft in accordance with the changes of the conditions such as the transportation load of the platform 2, the strength of the building, allowable electric power, allowable noise limit, and so forth.

The guide rails 31 for the guide rollers of the counter-weight 5 are disposed on both sides inside the frame 29 for guiding the platform 2 and the counter weight 5 along the slope surface between the upper and lower floors of the building as described above, and the guide rails 30 for the guide rollers of the platform 2 are disposed outside the guide rails 31 on the same plane as that of the former.

Figure 6:
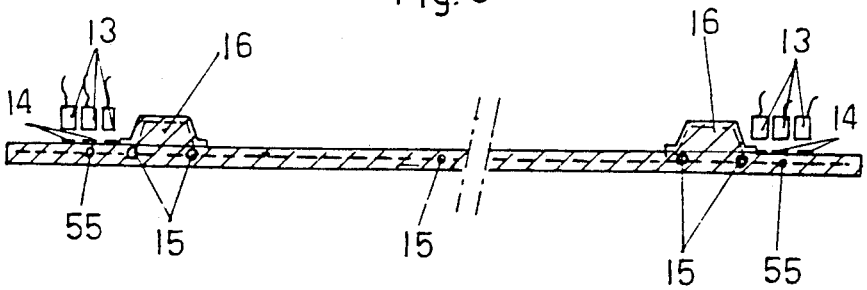
FIG. 6 is a sectional view of plain belts, a control tape and its reader.
Figure 7:
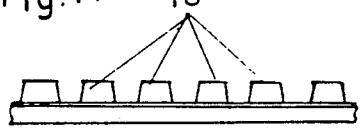
FIG. 7 is a side view of the plain belts.

As shown in FIGS. 6 and 7, the plain belts 1*a*, 1*b*, as the connecting member of the platform 2 and the counter-weight 5 have teeth 16 having the shape that meshes with the teeth 17 of the pullies 6 when the plain belts are wound into the pullies 6. Each plain belt 1*a*, 1*b*, is formed by using a buried wire rope 15 as a buried core material for the teeth 16 and other portions and a flexible decorative sheet on the opposite side to the surface having the teeth 16, beside a cloth-like reinforcing material.

Figure 18:
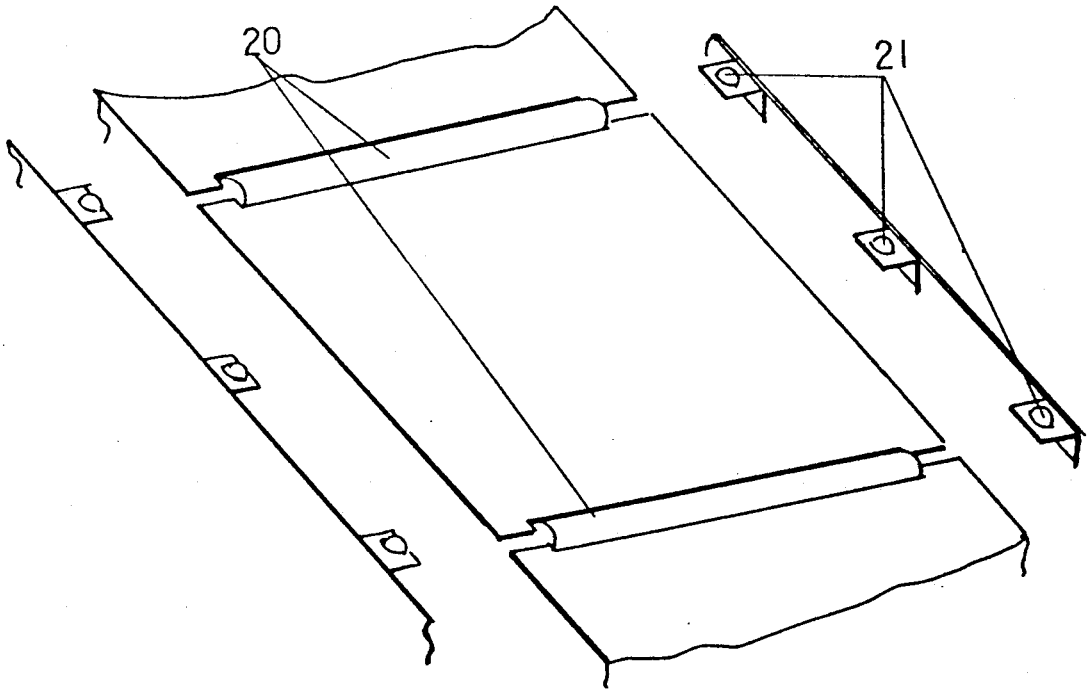
FIG. 18 is a perspective view of plain belt supports at the upper part of the frame.

FIG. 18 shows the support structure of the plain belts 1*a*, 1*b* on the upper surface of the frame 29 and both sides of the roller 20 buried into a cover plate are supported by falls 21.

Figure 13:
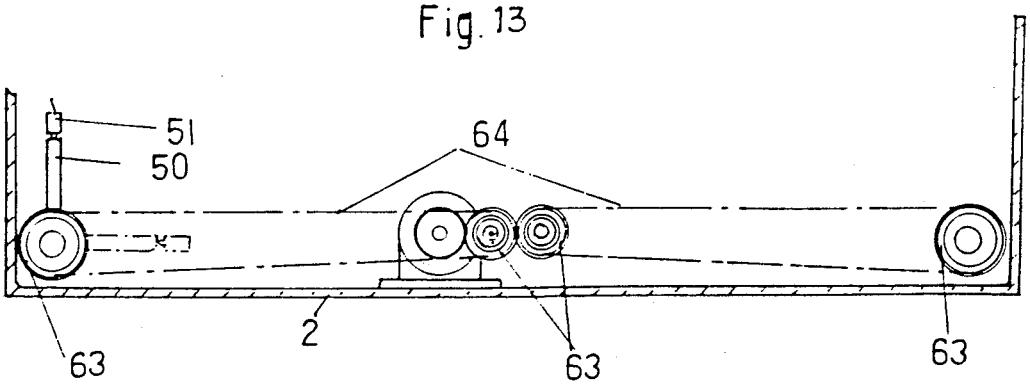
FIG. 13 is a plan view of a platform gate opening/-closing device.
Figure 14:
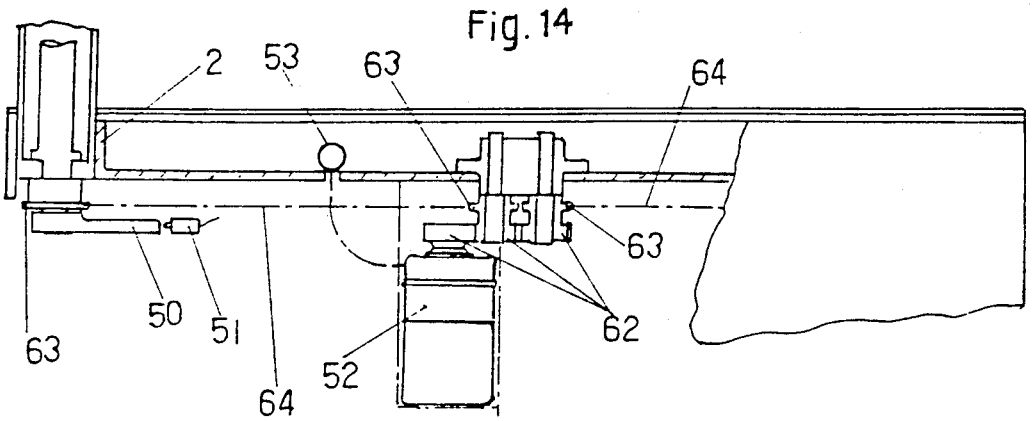
FIG. 14 is a sectional view of the side surface of the gate opening/closing device.

FIG. 13 and 14 show an opening/closing device of the platform gate 4. When the step surface of the platform 2 is at the floor surface of the lower floor and is stationary, a current collector 44 of the platform 2 comes into contact with a power feed member 43 of a pit inner frame and the motor 52 equipped with a reduction gear with a wire operation clutch for opening/closing the platform gate 4 operates. When the platform gate 4 must be opened in case of emergency, the window of the step surface is opened and a clutch wire 53 connected to a clutch is pulled. The opening/closing control of the platform gate 4 is made by a limit switch 51 operated by an arm 50 at the lower end of a gate shaft. Reference numeral 62 represents a gear that rotates in the interlocking arrangement with the motor 52 equipped with a reduction gear with a clutch described above. A sprocket wheel 63 meshes with this gear 62. Reference numeral 64 represents a roller chain, which transmits the rotation of the sprocket wheel 63 on another sprocket wheel 63 of the gate shaft.

Figure 8:
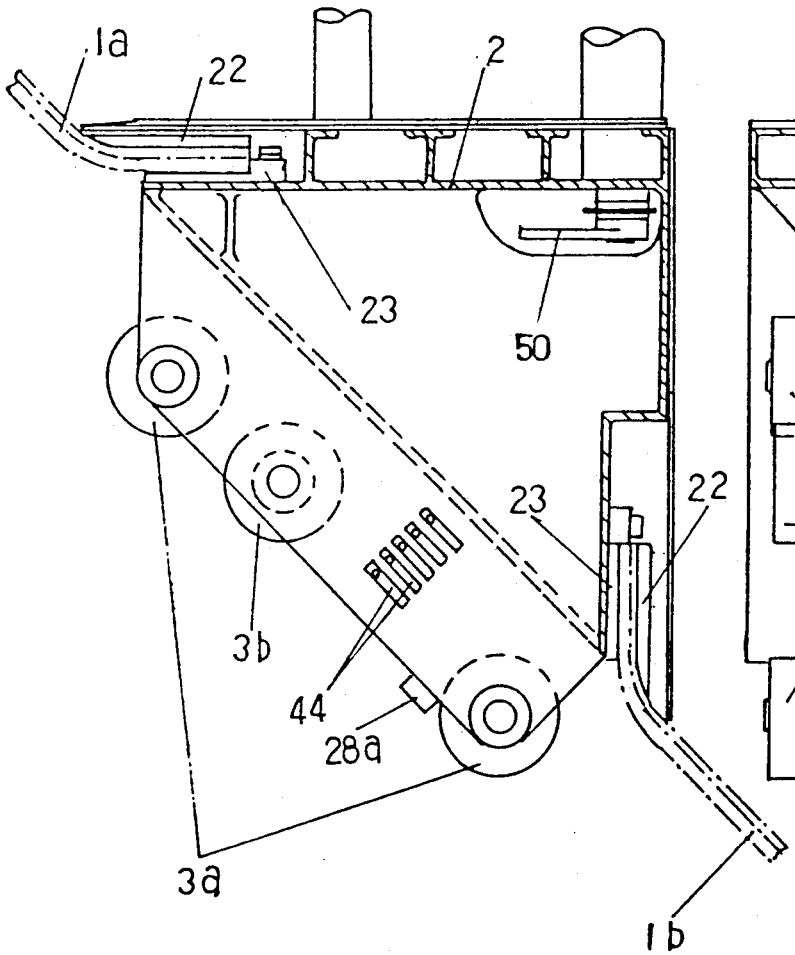
FIG. 8 is a partial sectional view of the lower part of the platform.
Figure 9:
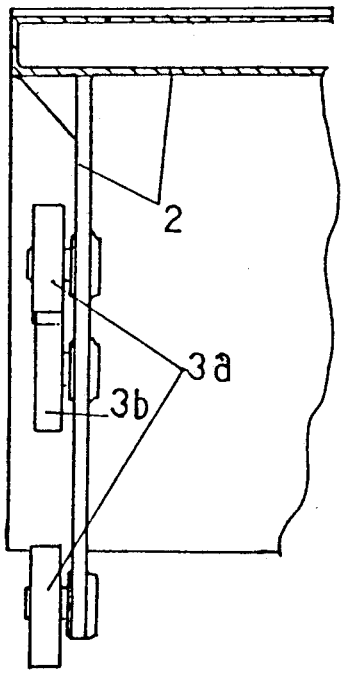
FIG. 9 is a front of the view of the platform.
Figure 10:
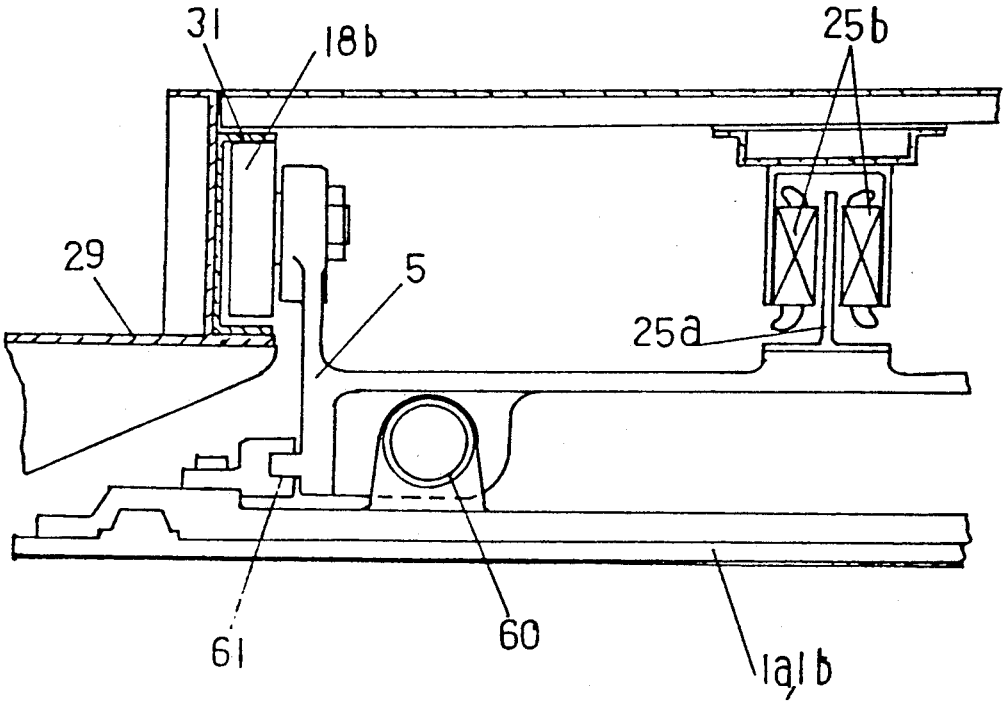
FIG. 10 is a sectional view of a counter-weight and a linear motor for elevation.
Figure 11:
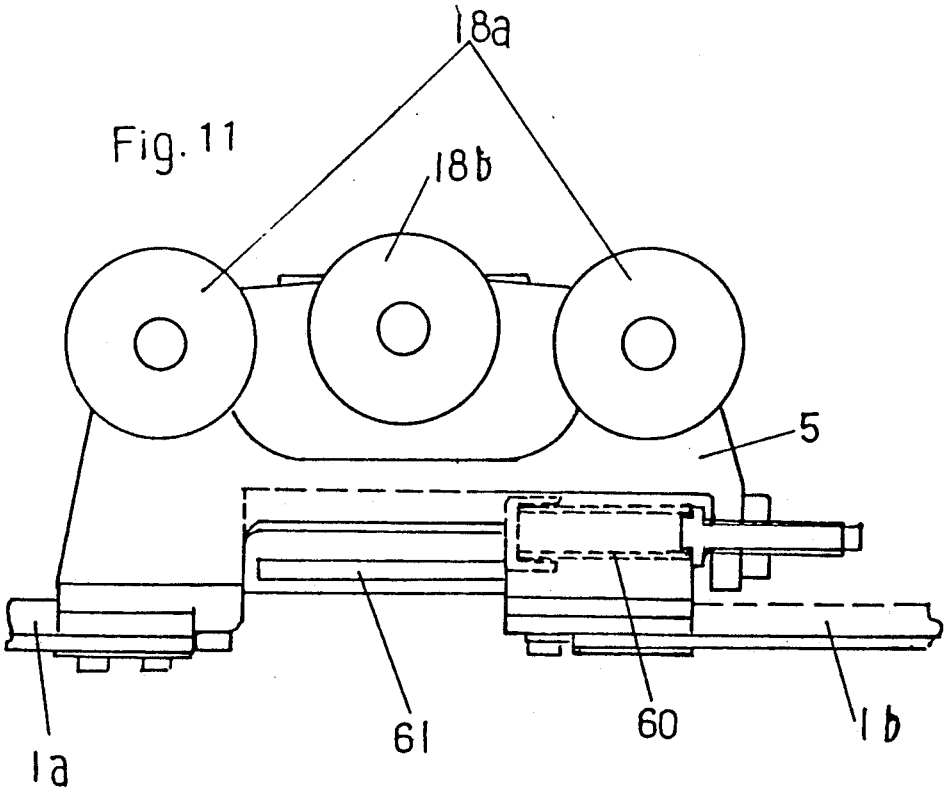
FIG. 11 is a front view of the counter-weight.
Figure 12:
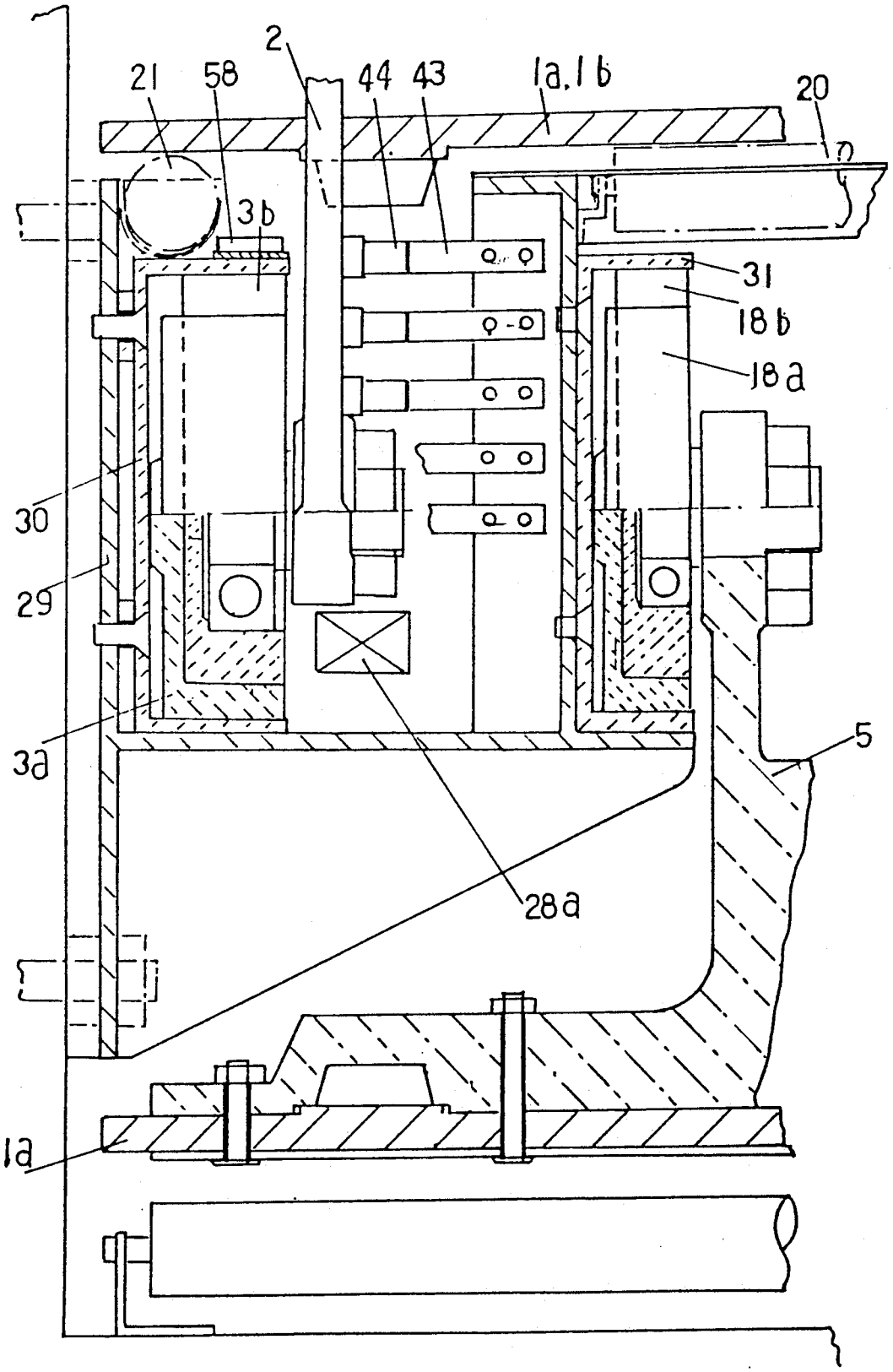
FIG. 12 is a partial sectional view taken along line X—X' and line Y—Y' of FIG. 1.
Figure 21:
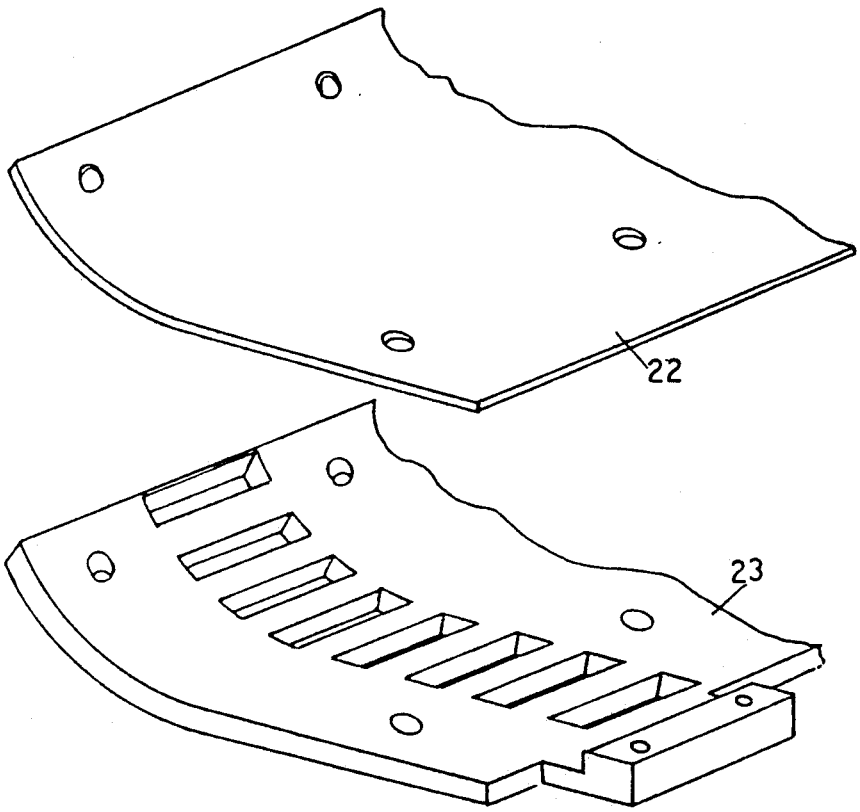
FIG. 21 is a perspective view of the lashing metals.

On the other hand, connection between the platform 2 and the plain belts 1*a*, 1*b* is made at the front and back of the platform 2 in its travelling direction. As shown in FIG. 8, the platform 2 is fixed by lashing metals 22 (FIG. 21) in a horizontal direction parallel to the step surface of the platform 2 on the upper floor side, in a vertical direction parallel to the vertical plane of the platform 2 on the lower floor side and at the portions coming into contact with the upper surface of the plain belts 1*a*, 1*b* whereby the lashing metals 22 have a plurality cylindrical section orthogonal to the travelling direction. At the portions coming into contact with the lower surface of the plain belts 1*a*, 1*b*, on the other hand, the platform 2 is fixed by lashing metals 23 having a shape which comes into close contact with the plain belts 1*a*, 1*b*. Furthermore, each buried wire rope 15 is exposed from the end of each plain belt 1*a*, 1*b* and is fixed to the platform 2.

The counter-weight 5 has guide rollers 18*a*, 18*b* and incorporates therein the belt tension regulation spring 60 for the plain belts 1*a*, 1*b* as the plain belt tension device. Connection between the counter-weight 5 and the plain belts 1*a*, 1*b* is made by the lashing metal 23 (FIG. 21) having the shape coming into close contact with the plain belts 1*a*, 1*b*, on the upper surface of the plain belts 1*a*, 1*b*. Furthermore, the buried wire rope 15 is exposed from each plain belt 1*a*, 1*b* and is fixed to the counter-weight 5.

The platform 2 is equipped with the guide rollers 3*a*, 3*b*, the platform gate 4, a cover 12, a handrail 10, an electromagnetic transmitter 28*a* for remote control using a battery as a power source and push buttons 11*a*, 11*b*, 11*c* for the ascension, descension and emergency stop of the platform 2.

The apparatus of the present invention is equipped with a control system which reads the optical symbols written in the travelling direction of the plain belts 1*a*, 1*b* during the ascension and descension of the platform 2 and controls the elevation speed, the safety speed and the operation of the slide plate 7 of the lower floor pit. In this case, tapes 14 which have flexibility and to the surface of which the optical symbols can be written are disposed inside the plain belts 1*a*, *1b*. The elevation speed levels corresponding to a preset position of the platform 2 and to the position of the platform 2 at the time of non-load are written continuously by symbols in the full length of the platform 2 from the lower floor to the upper floor. The tapes 14 are bonded at positions where reader 13 of the apparatus and the positions of the platform 2 correspond to one another, along the line of the reader 13. Similarly, the tapes 14 corresponding to the elevation of the platform 2 at the time of the mean load, its descension at the time of the non-load and its descension at the time of the mean load are bonded to the line of each reader 13. Furthermore, the tape for the symbol disposed equidistantly for speed detection and the tape for controlling the forward and backward speeds of the slide plate 7 are bonded along the line of each reader.

Figure 15:
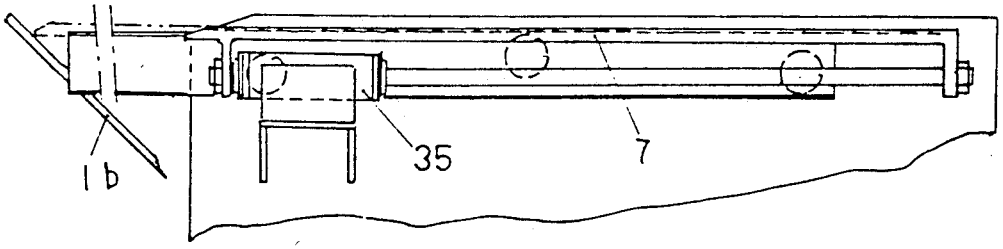
FIG. 15 is a side view of a device for moving back and forth a slide plate.
Figure 16:
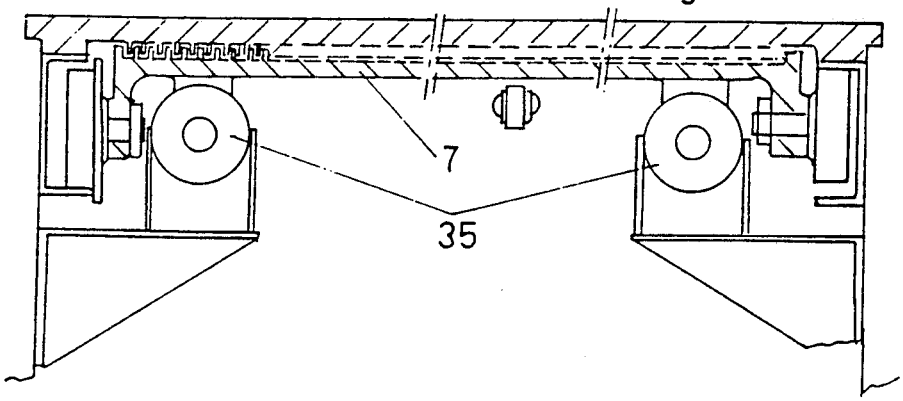
FIG. 16 is a sectional view of the device described above.
Figure 17:
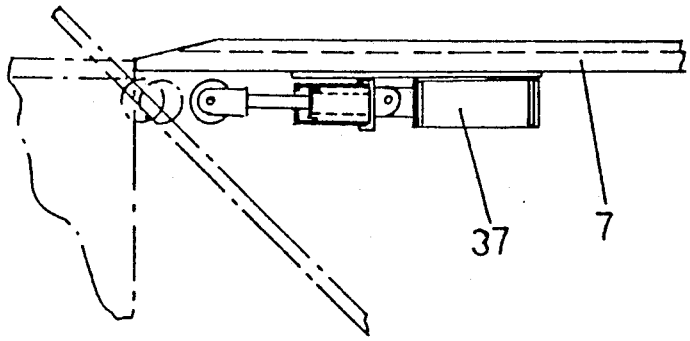
FIG. 17 is a side view of the tip portion of the slide plate.

FIGS. 15, 16 and 17 show an apparatus for the forward and backward movement of the slide plate 7. A spring equipped with a roller at its tip is pushed to the center portion of the vertical plane of the platform 2 by an electromagnetic solenoid 37 and the slide plate 7 is moved back and forth by a linear motor 35 for the forward and backward movement of the slide plate in accordance with the tape for controlling this apparatus.

When the platform 2 elevates from the lower floor, the slide plate 7 advances and follows up the platform 2 in synchronism with the rise of the platform 2 without defining the gap between the rear vertical plane of the platform 2 and the floor surface of the lower floor, and when the lower end of the rear vertical plane of the platform 2 leaves the lower floor pit, the slide plate 7 covers the entire surface of the pit. When the lower end of the rear back surface of the platform 2 comes into contact with the slide plate 7 at the time of descension of the platform 2, the slide plate 7 moves back in synchronism with the descension of the platform 2.

Next, the mode of use of the elevation apparatus in accordance with the present invention will be described.

Optical or pressure type proximity sensors for man are disposed in front of the slide plate 7 of the lower floor and in front of the upper floor gate 40 and a controller by a selector switch for selecting stand-by of the platform 2 at the lower floor or at the upper floor is disposed in the proximity of the sensors. In this case, the operation of this apparatus has the following four modes:

(1) When the platform 2 is under stand-by at lower floor:

Operation 1-1:

Passengers get into the apparatus from the lower floor to the upper floor.

Operation 1-2:

Passengers get into the apparatus from the upper floor to the lower floor.

(2) when the platform 2 is under stand-by at upper floor:

Operation 2-1:

Passengers get into the apparatus from the lower floor to the upper floor.

Operation 2-2:

Passengers get into the apparatus from the upper floor to the lower floor.

The operation 1-1 described above will be explained The platform gate 4 opens at the time of stand-by at the lower floor.

(1) A passenger pushes an UP button 11*a* of the handrail 10 of the platform 2.

(2) The platform gate 4 is closed.

(3) The limit switch 51 of the gate arm 50 operates and makes transmission to the current collection signal circuit.

(4) The platform 2 is moved up by the elevation control at the time of the mean load.

(5) The slide plate 7 is moved forth by the control tape.

(6) The slide plate 7 covers the pit and stops.

(7) The step surface of the platform 2 is in conformity with the upper open floor surface and the platform 2 stops.

(8) The upper floor gate 40 opens.

(9) The upper floor proximity sensor is operated.

10 The upper floor gate 40 closes.

11 The platform 2 moves down by the non-load descension control.

12 The vertical surface of the platform 2 comes into contact with the slide plate 7 and the slide plate 7 moves back.

13 The step surface of the platform 2 is in conformity with the floor surface of the lower floor and the platform 2 stops.

14 The slide plate 7 stops.

15 The support gate 4 opens.

16 The platform 2 enters the stand-by state at the lower floor.

The operation 2-2 described above with be explained.

The upper floor gate 40 is open and the platform gate 4 is closed at the time of stand-by at the upper floor.

(1) A passenger pushes a DOWN button 11*b* of the handrail 10 of the platform 2.

(2) The upper floor gate 40 is closed.

(3) Transmission is made from the electromagnetic wave transmitter 28*a* of the platform 2 to the electromagnetic wave receiver 28*b*.

(4) The platform 2 is moved down by the descension control at the time of mean load.

(5) The vertical plane of the platform 2 comes into contact with the tip portion of the slide plate 7.

(6) The slide plate (7) is moved back by the control tape.

(7) The step surface of the platform 2 is in conformity, with the floor surface of the lower floor and the platform 2 stops.

(8) The slide plate 7 stops.

(9) The platform gate 4 is opened through the current collector signal circuit.

(10) The lower floor proximity sensor operates.

(11) The platform gate 4 is closed.

(12) The platform 2 is moved up by the ascension control at the time of non-load.

(13) The slide plate 7 moves forth.

(14) The slide plate 7 covers the pit and stops.

(15) The step surface of the platform 2 is in conformity with the floor surface of the upper floor and the platform 2 stops.

(16) The upper floor gate 40 is opened.

(17) The platform 2 enters the stand-by state at the upper floor.

The operations 1-2 and 2-1 consist of the combinations described above.

Figure 19:
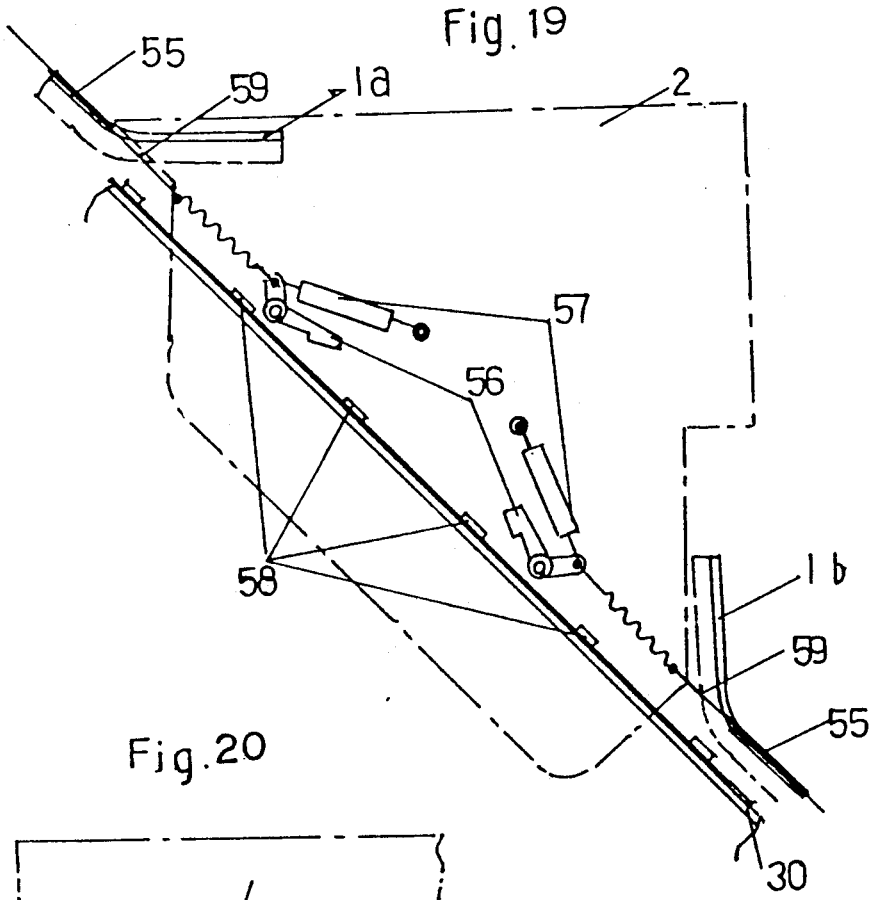
FIG. 19 is a front view showing the fitting state of teeth and levers on the frame, pawls, springs and wires.
Figure 20:
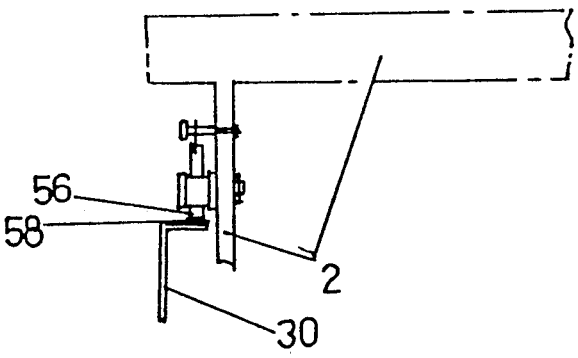
FIG. 20 is a side view of FIG. 19.

FIGS. 19 and 20 show a safety device provided to the elevation apparatus. A flexible thin pipe 55 is buried in each of the plain belts 1*a*, 1*b*, and a wire 59 is passed through the thin pipe 55 and is fixed on the counterweight 5 side and connected to a pawl 56 equipped with a lever on the platform 2 side through a spring 57. The length of the wire 59 is adjusted so that the lever is always at the position spaced apart from the teeth 58 on the frame 29 against the tension of the spring 57. If the wire 59 is cut at any position of the plain belt, the lever is returned by the spring 57 and the pawl 56 meshes with the tooth 58 on the frame. A pair of wires 59 in the thin pipes 55 are disposed on both sides of the plain belts 1*a*, 1*b* and the pawls 56 are fitted on both sides of the platform 2 to improve safety.

Since the present invention relates to the elevation method and employs the apparatus construction described above, it provides the following effects. Since the present invention has the platform gate on the single platform, the passengers are prevented from falling down one upon another even when a large number of passengers get in. Therefore, the angle of inclination can be made great, and the installation space may be small in conjunction with the disposition of the double guide rails inside the frame. The present invention can reduce necessary power by establishing the weight balance by the platform and the counter-weight and can be installed without affecting much the structure of a building. Since the plain belts and the linear motor elevation driving system are employed, the occurrence of noise can be limited. If a suitable decorative sheet is selected for the surface of the plain belts, good harmony can be established with the building and the present apparatus can be installed more easily in houses. The step surface of the platform can be enlarged and since the elevation method employs the stop-elevation-stop system, wheelchairs can easily get into and out from the present apparatus. Therefore, if the present apparatus is installed in hospitals or in public facilities, the use of wheelchairs can be improved. Since the present apparatus can be used as the refuge path, the space of a building can be saved.

Since the thin pipes are buried in the plain belts connecting the platform to the counter-weight and the wires are passed through the thin pipes as the safety device, it becomes possible to prevent accident such as abrupt fall of the platform to lower floors or abrupt rise to upper floors even if the plain belts are cut off or if connection of the plain belts with the platform and with the counter-weight is released. Thus, safety can be secured.

What is claimed is:

1. An elevation apparatus comprising:

a frame fitted to a sloped surface connecting the floor surface of a lower floor to the floor surface of an upper floor;

first guide rails;

a platform disposed inside said frame and having first guide rollers guided by said first guide rails and a platform gate on a step surface; and a counter-weight equipped with second guide rollers, and having second guide rails for said second guide rollers, said second guide rails being disposed inside said first guide rails;

said second guide rollers being guided by said second guide rails;

said platform and said counter-weight being connected to each other by divided plain belts through pullies disposed at the upper and lower ends of said frame at the front and back of said platform and said counter-weight, wherein said plain belts include (a) teeth having a shape which meshes with teeth of said pullies when said plain belts are wound into said pullies.

(b) a buried wire rope as a buried core material for said teeth, (c) a cloth-like reinforcing material, and (d) a flexible decorative sheet extended on the surface opposite to the surface having said teeth;

said elevation apparatus further comprising means for moving said platform, said moving means being selected from (A) a primary side stator of a linear motor fixed inside said frame, a secondary side moving element fixed to said counter-weight and corresponding to said primary side stator and a brake device fitted to a pulley shaft, and (b) a variable speed motor equipped with a reduction gear connected to said pulley shaft in accordance with the transportation load of said platform, the strength of the building, allowable electric power and allowable limit of noise.

2. An elevation apparatus comprising:

a frame fitted to a sloped surface connecting the floor surface of a lower floor to the floor surface of an upper floor;

first guide rails;

a platform disposed inside said frame and having first guide rollers guided by said first guide rails and a platform gate on a step surface; and a counter-weight equipped with second guide rollers, and having second guide rails for said second guide rollers, said second guide rails being disposed inside said first guide rails;

said second guide rollers being guided by said second guide rails;

said platform and said counter-weight being connected to each other by divided plain belts through pullies disposed at the upper and lower ends of said frame at the front and back of said platform and said counter-weight; wherein connection between said platform and said plain belts is made at the front and back in the travelling direction of said platform in a horizontal direction parallel to the step surface of said platform on the side of the upper floor and in a vertical direction parallel to the vertical plane of said platform on the side of the lower floor, by lashing metals having a partial cylindrical section orthogonal to the travelling direction at the portions coming into contact with the upper surfaces of said plain belts and by lashing metals coming into close contact with said plain belts at the portions coming into contact with the lower surfaces of said plain belts so as to fix said plain belts, respectively, and further wherein said plain belts include buried wire ropes exposed at the end portions of said plain belts and fixed to said platform; said elevation apparatus further comprising means for moving said platform, said moving means being selected from (a) a primary side stator of a linear motor fixed inside said frame, a secondary side moving element fixed to said counter-weight and corresponding to said primary side stator and a brake device fitted to a pulley shaft, and (b) a variable speed motor equipped with a reduction gear connected to said pulley shaft in accordance with the transportation load of said platform, the strength of the building, allowable electric power and allowable limit of noise.

3. An elevation apparatus comprising:

a frame fitted to a sloped surface connected the floor surface of a lower floor to the floor surface of an upper floor;

first guide rails;

a platform disposed inside said frame and having first guide rollers guided by said first guide rails and a platform gate on a step surface; and a counter-weight equipped with second guide rollers, and having second guide rails for said second guide rollers, said second guide rails being disposed inside said first guide rails;

said second guide rollers being guided by said second guide rails;

said platform and said counter-weight being connected to each other by divided plain belts through pullies disposed at the upper and lower ends of said frame at the front and back of said platform and said counter-weight, wherein said counter-weight includes plain belt stretch devices, and connection between said counter-weight and said plain belts is made on the upper surface of said plain belts by lashing metals coming into close contact with said plain belts and on the lower surface of said plain belts by flat sheet-like lashing metals, and further wherein buried wire ropes are exposed from end portions of said plain belts and are fixed to said counter-weight, respectively; said elevation apparatus further comprising means for moving said platform, said moving means being selected from (a) a primary side stator of a linear motor fixed inside said frame, a secondary side moving element fixed to said counter-weight and corresponding to said primary side stator and a brake device fitted to a pulley shaft, and (b) a variable speed motor equipped with a reduction gear connected to said pulley shaft in accordance with the transportation load of said platform, the strength of the building, allowable electric power and allowable limit of noise.

4. An elevation apparatus according to claim 1, wherein said frame fixed along the sloped surface between an upper floor and a lower floor for guiding said platform and said counter-weight is arranged in such a manner that said second guide rails are disposed inside and on both sides of said frame and said first guide rails are disposed on the same plane as, an outside, said second guide rails.

5. An elevation apparatus according to claim 2, wherein said frame fixed along the slope surface between an upper floor and a lower floor for guiding said platform and said counter-weight is arranged in such a manner that said second guide rails are disposed inside and on both sides of said frame and said first guide rails are disposed on the same plane as, and outside, said second guide rails.

6. An elevation apparatus according to claim 3, wherein said frame fixed along the sloped surface between an upper floor and a lower floor for guiding said platform and said counter-weight is arranged in such a manner that said second guide rails are disposed inside and on both sides of said frame and said first guide rails are disposed on the same plane as, and outside, said second guide rails.

7. An elevation apparatus according to claim 1, wherein said platform has said platform gate on the step surface, and when said platform step surface is on the floor surface of a lower floor and is stationary, said platform gate is opened and closed by signals through push buttons of said platform relayed by communication between a power feed member in said frame inside a pit and a current collector apparatus of said platform.

8. An elevation apparatus according to claim 2, wherein said platform has said platform gate on the step surface, and when said platform step surface is on the floor surface of a lower floor and is stationary, said platform gate is opened and closed by signals through push buttons of said platform relayed by communication between a power feed member in said frame inside a pit and a current collector apparatus of said platform.

9. An elevation apparatus according to claim 3, wherein said platform has said platform gate on the step surface, and when said platform step surface is on the floor surface of a lower floor and is stationary, said platform gate is opened and closed by signals through push buttons of said platform relayed by communication between a power feed member in said frame inside a pit and a current collector apparatus of said platform.

10. An elevation apparatus according to claim 1, wherein said platform has said platform gate on the step surface, and when said platform step surface is on the floor surface of a lower floor and is stationary, said platform gate is opened and closed by signals through a current collector apparatus of said platform.

11. An elevation apparatus according to claim 2, wherein said platform has said platform gate on the step surface, and when said platform step surface is on the floor surface of a lower floor and is stationary, said platform gate is opened and closed by signals through a current collector apparatus of said platform.

12. An elevation apparatus according to claim 3, wherein said platform has said platform gate on the step surface, and when said platform step surface is on the floor surface of a lower floor and is stationary, said platform gate is opened and closed by signals through a current collector apparatus of said platform.

13. An elevation apparatus according to claim 1, wherein said platform includes said first guide rollers, said platform gate, a cover, handrails, an electromagnetic wave transmitter for remote control including a battery as a power source, and push buttons for UP, DOWN and emergency stop, respectively, for operating said electromagnetic transmitter.

14. An elevation apparatus according to claim 2, wherein said platform includes said first guide rollers, said platform gate, a cover, handrails, an electromagnetic wave transmitter for remote control including a battery as a power source, and push buttons for UP, DOWN, and emergency stop, respectively, for operating said electromagnetic transmitter.

15. An elevation apparatus according to claim 3, wherein said platform includes said first guide rollers, said platform gate, a cover, handrails, an electromagnetic wave transmitter for remote control including a battery as a power source, and push buttons for UP, DOWN, and emergency stop, respectively, for operating said electromagnetic transmitter.

* * * * *